US007568506B2

(12) United States Patent
Deseyne et al.

(10) Patent No.: US 7,568,506 B2
(45) Date of Patent: Aug. 4, 2009

(54) HEALD FRAME

(75) Inventors: Joost Deseyne, Hoglede (BE); Frank Stockman, Kortrijk (BE)

(73) Assignees: Picanol N.V., Ieper (BE); Verbrugge N.V., Roeselare (BE)

( * ) Notice: Subject to any disclaimer, the term of this patent is extended or adjusted under 35 U.S.C. 154(b) by 0 days.

(21) Appl. No.: 11/791,369

(22) PCT Filed: Jul. 13, 2005

(86) PCT No.: PCT/EP2005/007596

§ 371 (c)(1),
(2), (4) Date: Oct. 1, 2007

(87) PCT Pub. No.: WO2006/058565

PCT Pub. Date: Jun. 8, 2006

(65) Prior Publication Data

US 2008/0110520 A1 May 15, 2008

(30) Foreign Application Priority Data

Dec. 2, 2004 (DE) ..... 10 2004 059 319

(51) Int. Cl.
*D03C 9/02* (2006.01)
*D03C 9/04* (2006.01)
*D03C 9/00* (2006.01)

(52) U.S. Cl. ..... 139/91; 139/92; 139/93

(58) Field of Classification Search ..... 139/91–93
See application file for complete search history.

(56) References Cited

U.S. PATENT DOCUMENTS 2,482,149 A * 9/1949 Blickenstorfer ..... 139/92
2,674,237 A * 4/1954 Peters ..... 315/46
2,708,455 A 5/1955 Kaufmann
3,151,634 A 10/1964 Kaufmann
3,754,577 A * 8/1973 Heller ..... 139/92
3,901,282 A * 8/1975 Kramer et al. ..... 139/92
4,387,742 A * 6/1983 Graf ..... 139/92
4,404,995 A 9/1983 Bowen et al.
4,492,256 A * 1/1985 Kramer ..... 139/92
4,503,890 A * 3/1985 Kramer ..... 139/92
4,633,916 A * 1/1987 Rast ..... 139/92
4,844,130 A * 7/1989 Blontrock ..... 139/92
4,901,767 A * 2/1990 Koch ..... 139/92
4,913,193 A * 4/1990 Faasse ..... 139/91
4,913,194 A * 4/1990 Kramer ..... 139/91
6,076,250 A * 6/2000 Spitzer ..... 29/557
6,789,580 B1 * 9/2004 Cardoen et al. ..... 139/92
6,926,042 B2 * 8/2005 Scheiwe ..... 139/91
6,994,122 B2 * 2/2006 Cardoen et al. ..... 139/91
7,290,569 B2 * 11/2007 Gesing ..... 139/91

FOREIGN PATENT DOCUMENTS

DE 1 535 855 7/1970
DE 39 37 657 6/1990

* cited by examiner

*Primary Examiner*—Bobby H Muromoto, Jr.
(74) *Attorney, Agent, or Firm*—Bacon & Thomas, PLLC

(57) ABSTRACT

A heald frame includes at least one frame part (10, 14) at least one heald carrying rod (16). A multitude of projections (25, 26), which are arranged one behind the other while being situated essentially in a row, are formed from the heald carrying rod (16) while projecting therefrom by means of plastic deformation and are held inside a recess (28) or the like of the frame part (10, 14).

5 Claims, 4 Drawing Sheets

Fig. 2
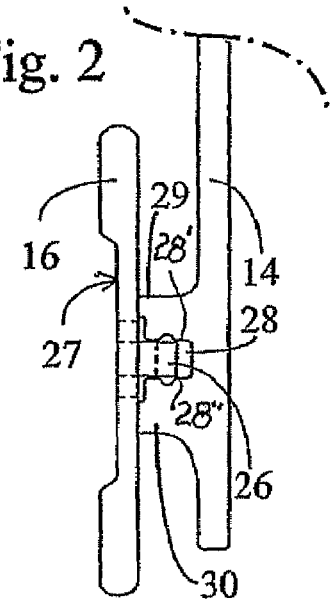
Fig. 3
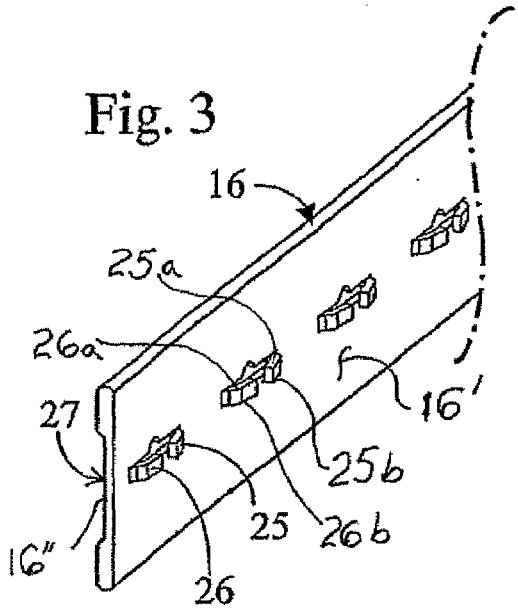
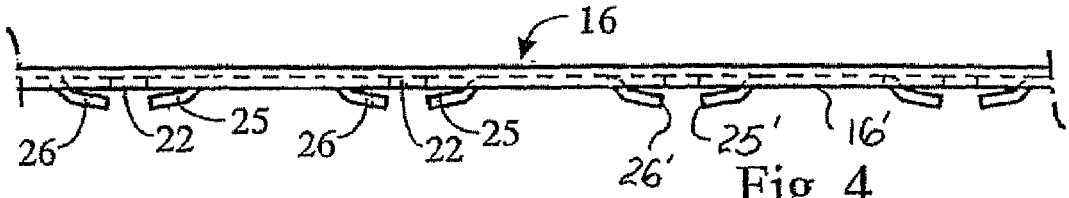
Fig. 4
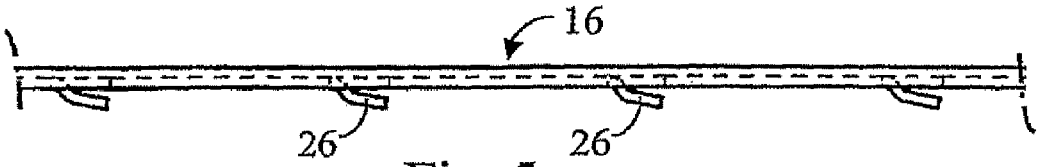
Fig. 5
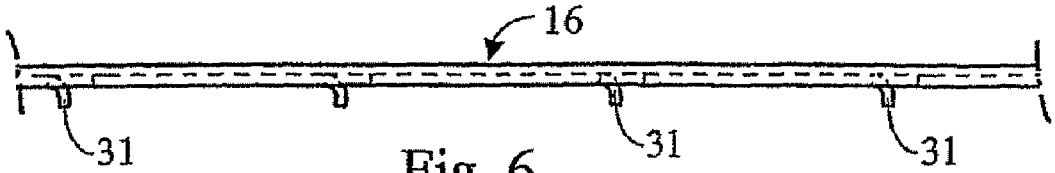
Fig. 6

HEALD FRAME

BACKGROUND

A. Field

The invention relates to a heald frame with at least one frame part and with at least one heald carrying rod which is fastened to the frame part.

B. Related Art

In order to achieve high weaving speeds, the aim is to have heald frames with as low a weight as possible. Despite the low weight, they must have high deformation resistance or flexural resistance, so that the healds are not loaded and/or damaged due to deformations of the heald frames. The healds themselves are to be held with play, in particular, in the raising and lowering direction of the heald frames, so that, in the repair of a warp thread break, they can easily be pushed to one side, without the risk of deformations of and/or damage to the healds. The heald carrying rods are to consist of as wear-resistant a material as possible. In practice, therefore, there is provision for the frame parts to be produced from a material of low specific gravity, in particular from aluminum or an aluminum alloy. The heald carrying rods are preferably produced from steel or similarly wear-resistant materials. Since the frame parts, on the one hand, and the heald carrying rods, on the other hand, consist of different materials which behave differently under stress and, in particular, are deformed differently, problems arise in practice.

It is known (U.S. Pat. No. 3,151,634) to provide the frame parts in each case with a flange which is directed toward the opposite frame part and which is reinforced by means of a longitudinal rib. The heald carrying rods, which possess a flat strip-shaped configuration, are fastened to this longitudinal rib of the frame parts. They have, on the side facing away from the longitudinal rib, a wide longitudinal groove, the depth of which corresponds approximately to half the thickness of the heald carrying rod. At a plurality of locations within the longitudinal groove, longitudinal slots are provided, into which are inserted mounting plates which are somewhat shorter than the slots. Spacer plates are arranged on the longitudinal rib of the frame parts. The heald carrying rods and the mounting plates are assigned clamping plates. The entire subassembly is held together by means of rivets which penetrate into the longitudinal rib of the flange of the frame part. It has been shown that a design of this type is relatively susceptible to fatigue fractures which occur due to relatively low, but changing forces. The bores in which the rivets are held on the flange of the frame part are particularly at risk.

It is also known (U.S. Pat. No. 3,754,577) to attach to the flanges of the frame parts two webs which run in the longitudinal direction and between them form a longitudinal groove. This longitudinal groove serves for receiving a middle web of T-shaped heald carrying rods. The middle web of these T-shaped heald carrying rods is held in the longitudinal grooves by means of an adhesive. The manufacture of T-shaped heald carrying rods of this type is relatively complicated and therefore costly, particularly when they are produced from a high-grade material.

SUMMARY OF THE INVENTION

The object on which the invention is based is to provide a heald frame of the type initially mentioned which is also suitable for high weaving speeds and which can be produced as cost-effectively as possible.

This object is achieved in that a multiplicity of projections arranged essentially one behind the other in a row are shaped out of the heald carrying rod by means of plastic deformation and are held in a clearance or the like of the frame part.

By means of the projections formed by plastic deformation, an essentially strip-shaped heald carrying rod is provided, which in functional terms is comparable essentially to a T-shaped heald carrying rod and which can be attached to a frame part in a corresponding way to a T-shaped heald carrying rod.

In an embodiment of the invention, there is provision for the frame part to be provided with a longitudinal groove which runs in the longitudinal direction of the heald carrying rod and in which the projections of the heald carrying rod are held.

In an embodiment of the invention, there is provision, further, for tabs to be bent out from the heald carrying rod. In this case, there is advantageously provision for the tabs to be bent about a bending axis running essentially transversely with respect to the longitudinal direction of the heald carrying rod. In this embodiment, there is advantageously provision, further, for the width of the tabs of the heald carrying rod to correspond essentially to the width of the longitudinal groove. This affords a mechanical hold between the heald carrying rods and the frame part.

DESCRIPTION OF THE DRAWINGS

Further features and advantages of the invention may be gathered from the following description of the embodiments illustrated in the drawings and from the subclaims.

FIG. 2 shows a part view in the direction of the arrow II of FIG. 1, FIG. 3 shows a perspective part view of a heald carrying rod according to the invention, FIG. 4 shows a view of the narrow side of the heald carrying rod according to FIG. 3, FIG. 5 shows a view, similar to FIG. 4, of another embodiment, FIG. 6 shows a view, similar to FIG. 4, of a further embodiment.

DETAILED DESCRIPTION OF PREFERRED EMBODIMENTS OF THE INVENTION

Figure 1:
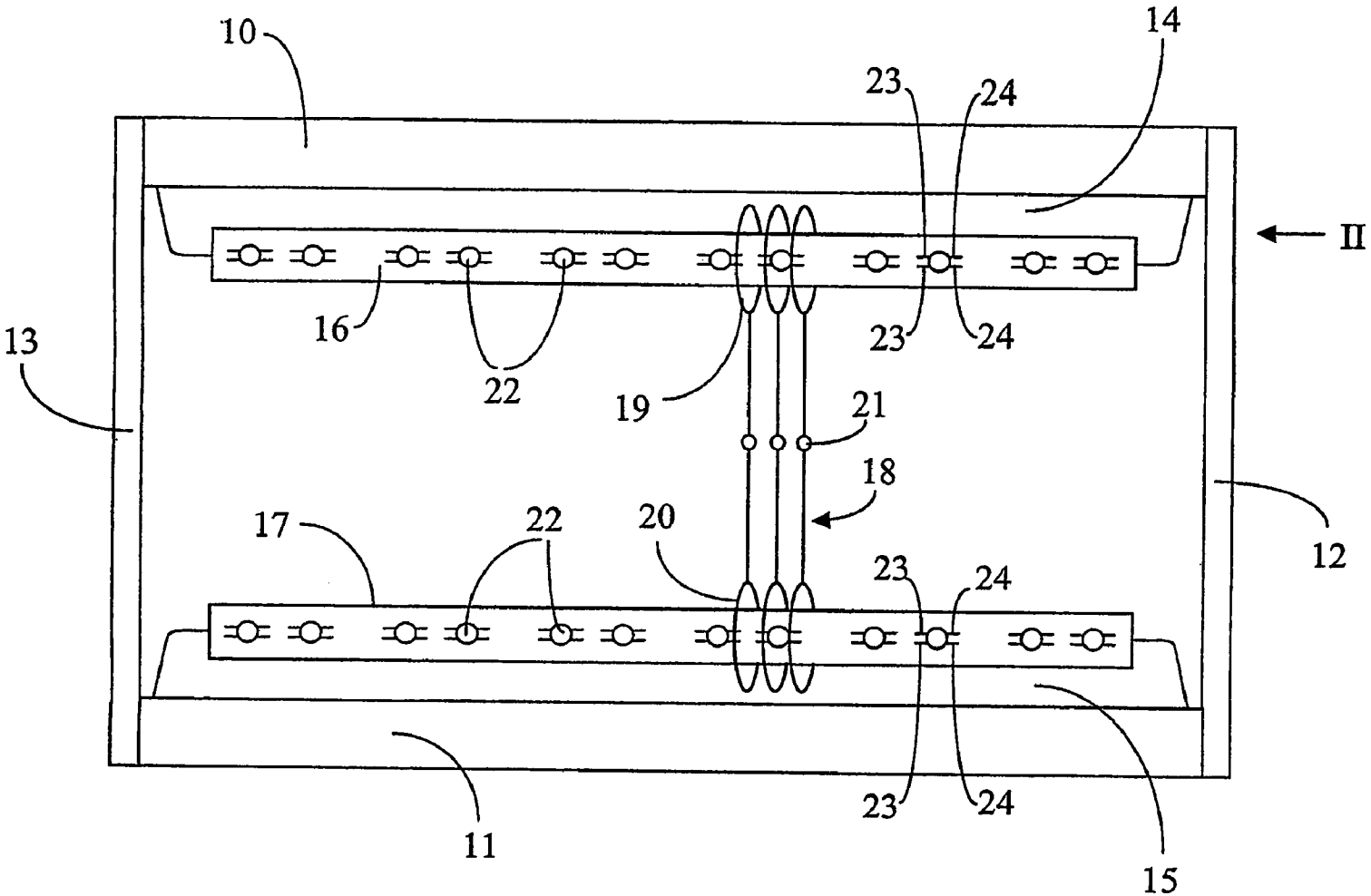
FIG. 1 shows a view of a diagrammatically illustrated heald frame according to the invention.

The heald frame illustrated in FIG. 1 possesses an upper frame part 10 and a lower frame part 11 which are connected to one another by means of two side parts 12, 13 to form a frame. The frame parts 10, 11 have the same cross section and are arranged mirror-symmetrically in respect to one another in such a way that two flanges 14, 15 lie opposite one another. Fastened to these flanges 14, 15 are heald carrying rods 16, 17 on which healds 18 are guided by means of eyes 19, 20. The healds 18 are provided with thread eyes through which the warp threads run. The eyes 19, 20 are guided on the heald carrying rods 16, 17 with a play such that the healds 18 can be displaced relatively easily on the heald carrying rods 16, 17, for example in order to eliminate a warp thread break.

In the exemplary embodiment, the frame parts 10, 11 have a profile of identical cross section. The heald carrying rods 16, 17 are likewise designed identically and are fastened to the frame parts 10, 11 in the same way, so that the following description, which refers to the upper frame part 10 and the upper heald carrying rod 16, also applies in the same way to the lower frame part 11 and the heald carrying rod 17.

The upper frame part 10 and the lower frame part 11 are, for example, extruded profiles consisting of aluminum or of an aluminum alloy. They are configured such that they possess as low a weight as possible, but high flexural resistance. The heald carrying rods 16, 17 are steel profiles, preferably extruded steel profiles.

A multiplicity of projections arranged one behind the other in a row are shaped out of the body of the heald carrying rods 16, 17 by means of plastic deformation, by means of which projections the heald carrying rods 16, 17 are fastened to the flanges 14, l5 of the frame parts 10, 11. The heald carrying rods 16, 17, as shown in the drawings, are elongated, rectangular plates having widths greater than their thickness, and extending in a single principal plane. The rod has a flat face area 16' extending parallel to the principal plane of the heald carrying rod. In the exemplary embodiment according to FIG. 1 to 4, perforations 22 have first been made in the middle region of the heald carrying rods 16, 17, said perforations having adjoining them on both sides shod incisions 23, 24 running in the longitudinal direction of the heald carrying rod. These incisions make it possible for projections in the form of tabs 25, 26 to be bent out from the main body of the heald carrying rod, as illustrated for the heald carrying rod 16 in FIGS. 2, 3 and 4. The tabs 25, 26 are located approximately in the longitudinal center of the heald carrying rod 16, said longitudinal center lying in the region of a longitudinal groove 27, the depth of which corresponds approximately to half the thickness of the heald carrying rod 16. The thickness of the tabs thus corresponds with the thickness of the heald carrying rod at the area where the tab is bent out. As can be seen particularly from FIGS. 3 and 4, in each case two tabs 25, 26 lie opposite one another in pairs. In the exemplary embodiment, the tabs 25, 26 are first bent out of the plane of the heald carrying rods 16 about a bending axis running essentially transversely with respect to the longitudinal direction of the heald carrying rod 16 and are then bent back in the direction of the heald carrying rod 16 at a distance from this bending axis. The tabs thus constitute an internal part of the heald rods and are formed as one integral piece therewith. The tabs 25, 26 which also may be referred to as tab sections when formed with disconnected terminal ends, also are unconnected to each other at their terminal ends 25', 26' which face towards each other. Each tab section 25, 26 moreover have flat upper and lower surfaces 25*a*, 25*b* and 26*a*, 26*b*, respectively, that extend parallel to each other, the flat surfaces also extending perpendicular to the flat face area 16 of the rod 16 from which the tabs 25, 26 project (see FIG. 3).

As can be seen from FIG. 2, the tabs 26 have a width which corresponds essentially to the width of a longitudinal groove 28 (which also may be referred to as a "recess" herein) formed between two webs 29, 30 which project from the flange 14 in the direction of the heald carrying rods 16 and which run in the longitudinal direction of the latter. The tabs 25, 26 are secured in the longitudinal groove 28 or recess by means of an adhesive. The widths of the tabs 25, 26 are shorter than the lengths of the tabs, and are configured to be received within the recess 28, which recess includes upper and lower surfaces 28', 28" extending perpendicular to the frame part 14 in close fitting relationship, as shown in FIG. 2, with the tab upper and lower surfaces extending parallel with the recess upper and lower surfaces. The recess 28, moreover, does not extend through the thickness of the frame part 14. The adhesive connection between the tabs and the recess constitutes the only fastening arrangement between the frame part and the heald carrying rod, as shown in FIG. 2.

The tabs 25, 26 may be bent out of the plane of the heald carrying rod 16 before the latter is mounted on the flange 14 of the frame part 10. It is also possible, however, to press the tabs out of the plane of the heald carrying rods 16 and into the longitudinal groove 28 of the flange 14 when the heald carrying rod 16 already bears against the two webs 29, 30 which between them form the longitudinal groove or recess 28.

The projections, formed by plastic deformation, of the heald carrying rods 16, 17 may be provided in highly diverse forms. In the embodiment according to FIG. 5, there is provision for only one form of tabs 26 to be bent out of the heald carrying rod 16 in each case. In the embodiment according to FIG. 6, tabs 31 which project essentially perpendicularly from the outer surface or flat face area 16' of the heald carrying rod 16 are bent out of the heald carrying rod 16.

Figure 7:
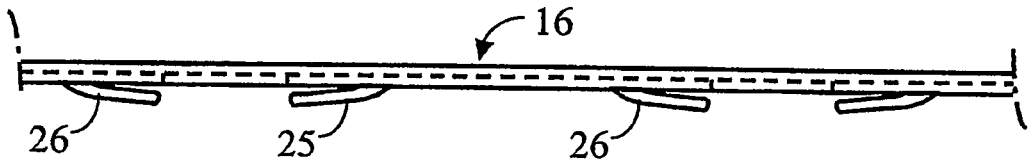
FIG. 7 shows a view of an embodiment similar to FIGS. 3 and 4.

In the embodiment according to FIG. 7, the tabs 25, 26 of the heald carrying rod 16 which are directed oppositely to one another are arranged at a greater distance from one another. The tabs preferably stamped out from the heald carrying rod 16 can advantageously be glued into the longitudinal groove 28 or recess of the frame part 10, 14 and afford relatively good securing against displacement in the longitudinal direction.

Figure 8:
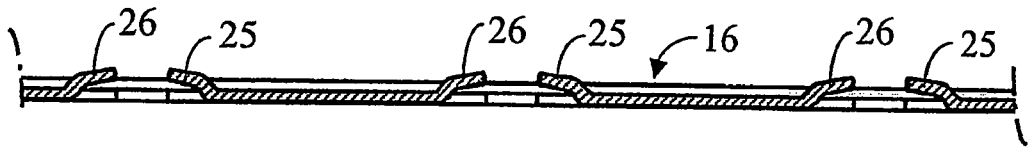
FIG. 8 shows a longitudinal section through a heald carrying rod similar to FIGS. 3 and 4.

In the embodiment according to FIG. 8, the tabs 25, 26 are bent out of the flat bottom area 16" of the longitudinal groove 27 toward the open side of the latter, that is to say oppositely to the tabs 25, 26 of the embodiment according to FIG. 3. In this embodiment, the heald carrying rod 16 is mounted on the frame part 10 or 11 such that the longitudinal groove 27 faces the longitudinal groove or recess 28.

Figure 9:
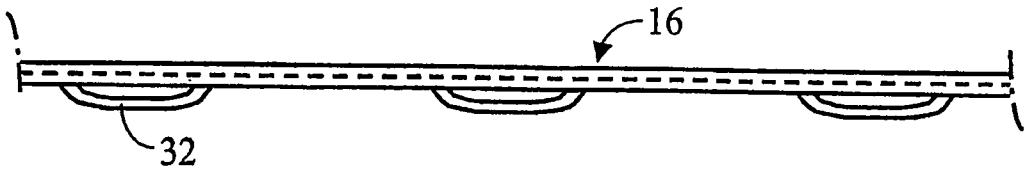
FIG. 9 shows a view, similar to FIG. 4, of a further embodiment.

In the embodiment according to FIG. 9, the projections 32 are pressed in the form of continuous, uninterrupted loops or eyes out of the heald carrying rod 16. For this purpose, the heald carrying rod is provided in the region of the projections 32 in each case with parallel longitudinal slots which make it possible for the projections 32 to be pressed out. The longitudinal slots may be formed and the projections 32 pressed out in one operation or else in a plurality of operations in succession.

Figure 10:
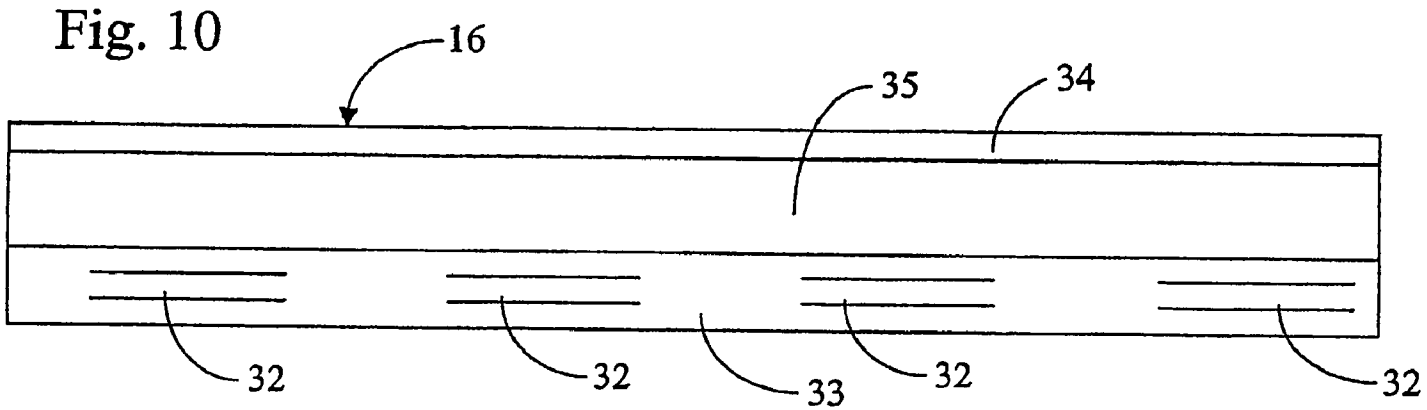
FIG. 10 shows a front view of a further embodiment of a heald carrying rod for a heald frame.
Figure 11:
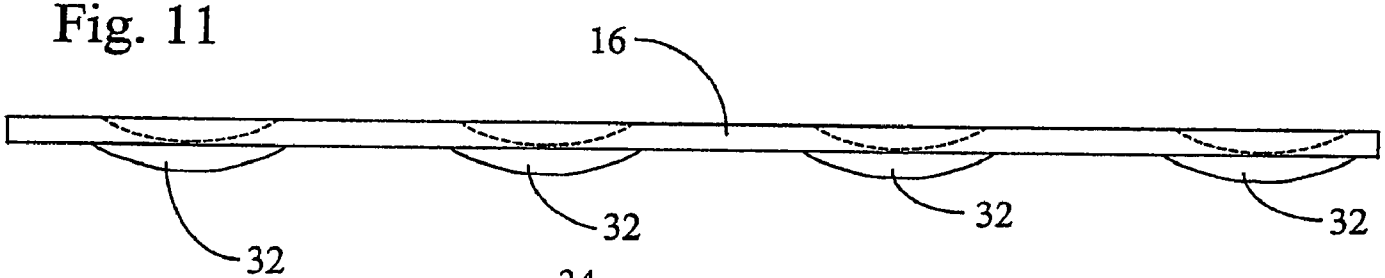
FIG. 11 shows a top view of the heald carrying rod of FIG. 10.
Figure 12:
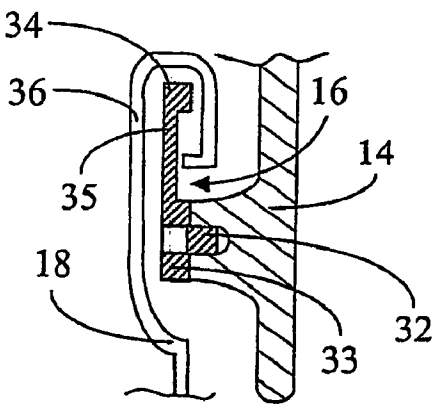
FIG. 12 shows a section through a frame part with a heald carrying rod according to FIGS. 10 and 11.

In the embodiment according to FIG. 10 to 12, the heald carrying rod 16 is provided with boss-like projections 32 which are pressed out on one side and which lie one behind the other in a row and are pressed out of the material of the heald carrying rod 16 only to an extent such that sufficiently large upper and lower surfaces are present which are sufficient to allow gluing into a clearance of the flange 14 of a frame part. The projections 32 have been pressed out from the heald carrying rod 16 only to an extent such that the approximately parallel top sides and undersides of the projections are also still connected to the material of the heald carrying rod 16. In the embodiment according to FIG. 10 to 12, the projections are not provided in the region of a longitudinal groove 35 of the heald carrying rod 16, but, instead, in the region 33 which is located beneath it and which has a greater thickness. The longitudinal groove 35 and the region 33 located beneath it and also that region 34 of the heald carrying rod 16 which lies above it are designed such that they can receive healds 18 having J-shaped guide elements 36.

In a modified embodiment, there is provision for the projections produced by plastic deformation to be arranged in more than one row running in the longitudinal direction of the heald carrying rod, for example in two rows. A heald carrying rod of this type can then be fastened to a frame part in such a way that the projections of the heald carrying rod surround a longitudinal rib of the flange 14 or 15 of the frame parts 10 or 11 from above and below.

In another modified embodiment, there is provision for the projections to be bent out in a tab-like manner about bending axes running in the longitudinal direction of the heald carrying rod. Tab-like projections of this type may also have a hook-like configuration, engaging behind corresponding profilings of the frame part and bringing about additional mechanical securing. In this case, use may be made of the fact that the heald carrying rods may be attached to a projection of a flange 14 or 15 of the frame parts 10, 11 or in a longitudinal groove by displacement in the longitudinal direction.

In a modified version, the frame parts 10, 11 are made from fiber-reinforced plastic, in particular from plastic reinforced with carbon fibers or Kevlar fibers. The invention is also suitable for heald frames which have only one frame part 10 or 11 with a heald carrying rod 16 or 17 fastened to it.

The invention claimed is:

1. A heald frame comprising at least one frame part having a thickness and a length and including at least one recess extending lengthwise of the frame part and not extending through the thickness of the frame part; said recess having flat upper and lower recess surfaces extending perpendicular to the frame part; at least one heald carrying rod in the form of an elongated rectangular plate extending in a principal plane and having a width greater than its thickness, and having a face area extending parallel with the principal plane of the heald carrying rod, and disposed adjacent to and facing towards the frame part, the rod having a multiplicity of individual tabs extending outwardly from said face area and out of the plane of the heald carrying rod along a length of the heald carrying rod; said tabs being formed integrally in one piece with the heald carrying rod, each tab having a flat top and bottom surface, the top and bottom surfaces extending parallel to each other and in planes extending perpendicular to the face area; said tabs being configured to be received and attached within the at least one recess of the frame part with the top and bottom surfaces of the tabs extending parallel with and adjacent to the upper and lower recess surfaces of the frame part; said tabs adhesively bonded within the recess of the frame part, with said adhesive constituting the only attachment holding the heald carrying rod against separation from the frame part.

2. The heald frame as claimed in claim 1, said heald carrying rod having a central thickness and said tabs comprising deformed portions of the central thickness of the heald carrying rod, wherein the tabs are the same thickness as the central thickness and each tab comprise a pair of tab sections each having a length greater than its width, with the tab sections having terminal portions aligned with and facing each other in a lengthwise direction along the heald carrying rod, with a space between the terminal portions of the tab sections; and transverse apertures in the central thickness of the heald carrying rod each located in alignment with the spaces between the terminal portions of the tab sections.

3. The heald frame as claimed in claim 1, wherein said tabs have opposed ends and comprise continuous uninterrupted elements connected at their opposed ends to the heald carrying rod.

4. The heald frame as claimed in claim 1, wherein said tabs have terminal ends all facing in the same direction along the heald carrying rod.

5. The heald frame as claimed in claim 1, wherein said tabs have terminal ends facing away from the face area and towards the frame part.

* * * * *